US007152680B2

(12) United States Patent
Wilson et al.

(10) Patent No.: US 7,152,680 B2
(45) Date of Patent: Dec. 26, 2006

(54) SLICKLINE POWER CONTROL INTERFACE

(75) Inventors: Paul Wilson, Houston, TX (US); Kevin L. Gray, Friendswood, TX (US); Corey E. Hoffman, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/209,899

(22) Filed: Aug. 23, 2005

(65) Prior Publication Data

US 2005/0279503 A1 Dec. 22, 2005

Related U.S. Application Data

(62) Division of application No. 10/212,673, filed on Aug. 5, 2002, now Pat. No. 6,945,330.

(51) Int. Cl.
*E21B 43/119* (2006.01)
*E21B 47/024* (2006.01)

(52) U.S. Cl. ..... 166/298; 166/255.2; 166/55.1; 175/4.51; 73/152.57

(58) Field of Classification Search ..... 166/297, 166/298, 255.1, 255.2, 55, 55.1, 55.6, 381; 175/2, 4.51, 45; 73/152.57
See application file for complete search history.

(56) References Cited

U.S. PATENT DOCUMENTS 3,097,693 A * 7/1963 Terrel ..... 166/255.2
3,104,709 A * 9/1963 Kenneday et al. ..... 175/4.51
3,105,546 A * 10/1963 Ownby et al. ..... 175/4.51
3,294,163 A * 12/1966 Lebourg ..... 166/255.2
3,704,749 A * 12/1972 Estes et al. ..... 166/255.2
3,964,553 A * 6/1976 Basham et al. ..... 175/4.51
4,410,051 A * 10/1983 Daniel et al. ..... 175/4.51
4,849,699 A 7/1989 Gill et al.
4,852,648 A 8/1989 Akkerman et al.
4,901,069 A 2/1990 Veneruso
4,916,617 A 4/1990 Norwood
5,146,983 A 9/1992 Hromas et al.
5,207,272 A 5/1993 Pringle et al.
5,236,048 A 8/1993 Skinner et al.
5,343,963 A 9/1994 Bouldin et al.
5,375,658 A 12/1994 Schultz et al.
5,492,173 A 2/1996 Kilgore et al.
5,555,220 A 9/1996 Minto
5,577,560 A 11/1996 Coronado et al.
5,582,248 A * 12/1996 Estes ..... 166/255.2
5,587,707 A 12/1996 Dickie et al.
6,076,268 A * 6/2000 Fuhr ..... 33/304
6,105,690 A 8/2000 Biglin, Jr. et al.
6,223,821 B1 5/2001 Coronado
6,367,545 B1 4/2002 Van Buskirk et al.
6,378,607 B1 * 4/2002 Ryan et al. ..... 166/255.2
6,469,635 B1 * 10/2002 Hudson ..... 340/854.4

(Continued)

FOREIGN PATENT DOCUMENTS

EP 1 149 980 10/2001

(Continued)

*Primary Examiner*—Jennifer H. Gay
(74) *Attorney, Agent, or Firm*—Patterson & Sheridan, LLP

(57) ABSTRACT

An apparatus, method, and system for use in operating an electric downhole tool on a non-conductive support line (slickline) by converting a battery voltage to an output voltage suitable for operating the tool. In response to receiving a trigger signal, the output voltage signal is applied to the tool. The tool is controlled by varying the output voltage signal according to a power control sequence. Accordingly, electric tools typically requiring surface intervention by an operator via an electric cable (wireline) may be operated on slickline.

13 Claims, 10 Drawing Sheets

U.S. PATENT DOCUMENTS

| | | | | |
|---|---|---|---|---|
| 6,655,460 | B1 | 12/2003 | Bailey et al. | |
| 6,820,693 | B1 * | 11/2004 | Hales et al. | 166/297 |
| 6,945,330 | B1 * | 9/2005 | Wilson et al. | 166/373 |
| 2001/0032721 | A1 | 10/2001 | Rider et al. | |
| 2002/0007949 | A1 | 1/2002 | Tolman et al. | |
| 2003/0098157 | A1 * | 5/2003 | Hales et al. | 166/297 |
| 2003/0155120 | A1 | 8/2003 | Richards et al. | |
| 2004/0020709 | A1 | 2/2004 | Wilson et al. | |
| 2004/0108108 | A1 | 6/2004 | Bailey et al. | |

FOREIGN PATENT DOCUMENTS

| | | |
|---|---|---|
| WO | WO 99/37044 | 7/1999 |
| WO | WO 9937044 A1 * | 7/1999 |

* cited by examiner

SLICKLINE POWER CONTROL INTERFACE

CROSS-REFERENCE TO RELATED APPLICATIONS

This application is a divisional of U.S. patent application Ser. No. 10/212,673, filed on Aug. 5, 2002, now U.S. Pat. No. 6,945,330, which is herein incorporated by reference.

BACKGROUND OF THE INVENTION

1. Field of the Invention

Embodiments of the present invention generally relate to downhole logging and production operations and particularly to deployment of downhole tools on non-electric cable.

2. Description of the Related Art

Costs associated with downhole drilling and completion operations have been significantly reduced over the years by the development of tools that can be deployed down a well bore to perform operations without pulling production tubing. Downhole tools are typically attached to a support cable and subsequently lowered down the well bore to perform the desired operation. Some support cables, commonly referred to as wirelines, have electrically conductive wires through which voltage may be supplied to power and control the tool.

FIG. 1 illustrates an exemplary electric downhole tool 110 attached to a wireline 120, lowered down a well bore 130. The wireline 120 comprises one or more conductive wires 122 surrounded by an insulative jacket 124. The conductive wires 122 supply a voltage signal to the tool 110 from a voltage source 140 at the surface 150. Typically, an operator at the surface 150 controls the tool 110 by varying the voltage signal supplied to the tool 110. For example, the operator may apply and remove the voltage signal to cycle power on and off, adjust a level of the voltage signal, or reverse a polarity of the voltage. The tool 110 is designed to respond to these voltage changes in a predetermined manner. As an example, an inflatable setting tool may toggle between a high volume-low pressure pump and a low volume high-pressure pump when power is cycled.

A less expensive, non-electric support cable is commonly referred to as slickline. Because slickline has no conductive lines to supply power to the attached tool, the types of the tools deployed on slickline are typically non-electric tools, such as placement and retrieval tools, mandrels, etc. Recently, battery powered tools have recently been developed for slickline operation. Operation of the battery powered tools may be initiated by lowering a slip ring device down the slickline that comes in contact with a switching device on a top surface of the tools. Alternatively, operation of the tools may be initiated by a triggering device that generates a trigger signal, for example, based upon bore hole pressure (BHP), bore hole temperature (BHT), and tool movement. Regardless of the method of initiation, the absence of electrically conductive wires prevents conventional surface intervention used to control wireline tools, which typically limits tools deployed on slickline to simple tools requiring little or no control, such as logging tools.

Accordingly, what is needed is an improved method and apparatus for operating electric downhole tools deployed on slickline.

SUMMARY OF THE INVENTION

Embodiments of the present invention generally provide a method, apparatus and system for operating an electric downhole tool on a non-conductive support line (slickline). The method comprises generating an output voltage signal from a battery voltage signal, applying the output voltage signal to the tool in response to receiving a trigger signal, and varying the output voltage signal applied to the tool to autonomously control the tool.

The apparatus comprises an output voltage circuit to generate an output voltage signal from a battery voltage signal and apply the output voltage signal to the tool in response to one or more control signals, and a microprocessor configured to autonomously control the tool by generating the one or more control signals according to a power control sequence stored in a memory.

The system comprises a non-electric cable, an electric downhole tool attached to the non-electric cable, and a power control interface comprising an output voltage circuit to generate an output voltage signal from a battery voltage and a microprocessor configured to autonomously control the tool by applying the output voltage signal to the tool and varying the output voltage signal according to a power control sequence stored in a memory, wherein the power control sequence is initiated by a trigger signal.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention generally provide an apparatus, method, and system for operating an electric downhole tool on a non-conductive support line (slickline). An advantage to this approach is that electric tools typically requiring voltage supplied through a wireline may be operated on the less expensive slickline, thereby reducing operating costs. Further, by enabling slickline operation of existing tools designed to operate on wireline, costly design cycles to develop new electric tools for operation on slickline may be avoided.

Figure 2:
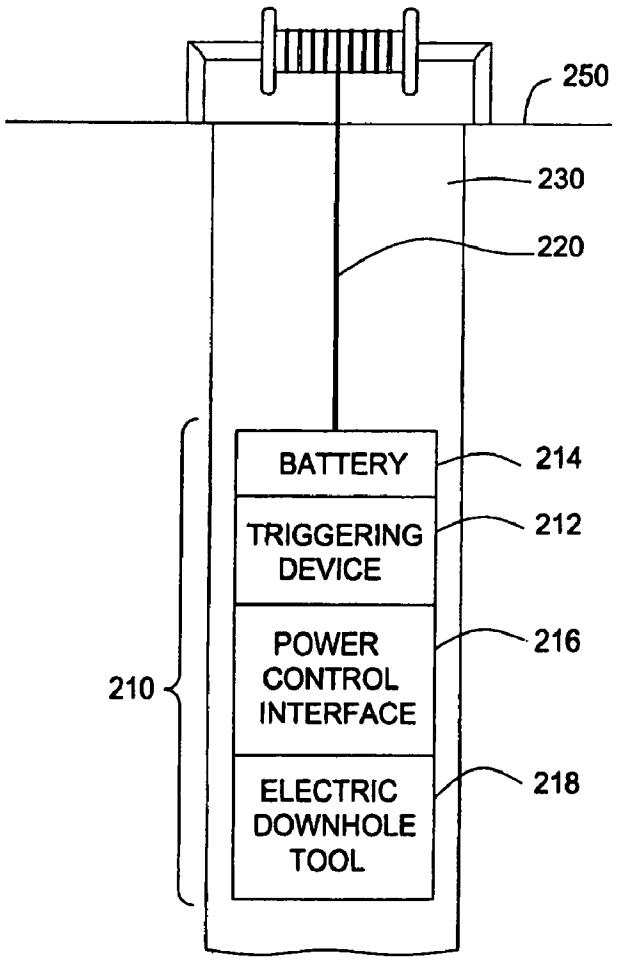
FIG. 2 illustrates an exemplary slickline tool string according to one embodiment of the present invention.
Figure 1:
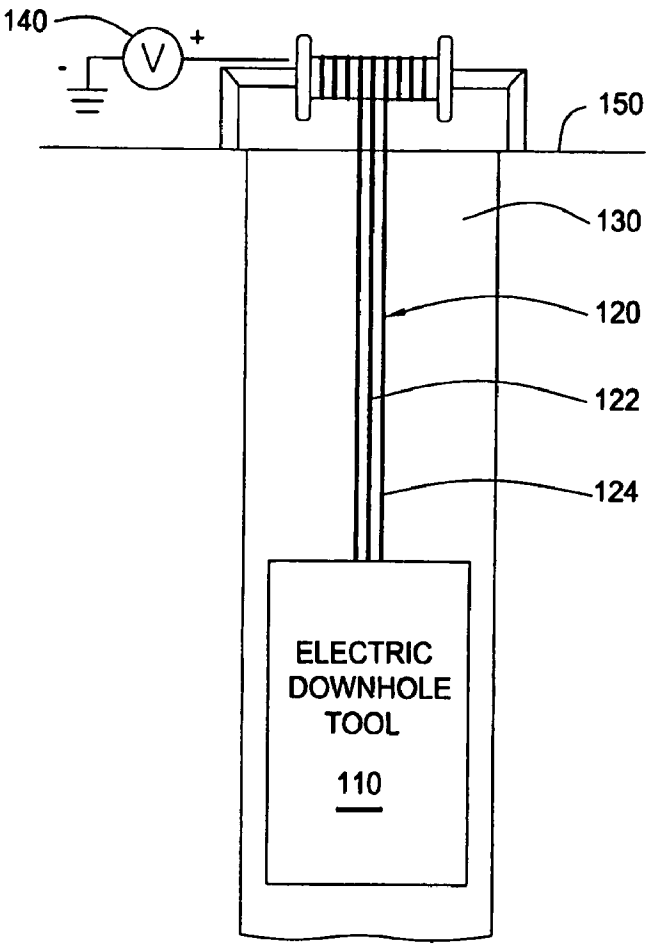
FIG. 1 (PRIOR ART)
FIG. 1 illustrates an exemplary wireline tool according to the prior art.

FIG. 2 illustrates an exemplary downhole tool string 210 attached to a non-electric cable (slickline or coiled tubing) 220, which is lowered down a well bore 230. The tool string 210 comprises a triggering device 212, a battery 214, a power control interface 216 and an electric downhole tool 218. The power control interface 216 provides autonomous control of the tool 218, which may be any suitable downhole tool, such as those typically operated on electric cables (wireline). For example, the tool 218 may perform bailing operations, set a mechanical plug or packer, or set an inflatable plug or packer. Power control operations traditionally performed via wireline by an operator on a surface 250 are performed by the power control interface 216. As used herein, the term autonomous means without intervention from the surface. In other words, once the tool is activated (i.e., triggered, the tool operates without surface intervention).

The triggering device 212 generates a trigger signal upon the occurrence of predetermined triggering conditions. For example, the triggering device 212 may monitor parameters such as bore hole temperature (BHT), bore hole pressure (BHP), and movement of the tool string 210. The triggering device 212 may generate a trigger signal upon determining the tool string 210 has stopped moving (i.e. has reached a desired depth) and that the BHT and BHP are within the operating limits of the tool 218. Alternatively, as previously described, a trigger signal may be generated by lowering a slip ring device (not shown) down the slickline 220 to contact a switch (not shown) on a top surface of the triggering device 212.

The trigger signal may be any suitable type signal, and for some embodiments, the triggering device 212 may supply a voltage signal from the battery 214 to the power control interface 216 as a trigger signal. The battery 214 may be any suitable battery capable of providing sufficient power to operate the tool 218. A physical size of the battery 214 depends on the operating power of the tool. For example, a battery capable of supplying 120 volts at 1.5 amps to a tool for 0.5 hours may be over six feet long if a diameter of the well bore is 2.5 inches.

In response to receiving the trigger signal, the power control interface 216 converts a voltage signal from the battery 214 into an output voltage signal suitable for operating the tool 218. The power control interface 216 applies the output voltage signal to the tool 218. The power control interface 216 autonomously controls the tool 218 by varying the output voltage signal applied to the tool 218 according to a predetermined power control sequence. Hence, the combination of the battery 214 and the power control interface 216 acts as an intelligent power supply.

For some embodiments, the tool assembly may be lowered down the wellbore on a lowering member other than a slickline, such as a coiled tubing. The methods and apparatus described herein for operating an electric tool on slickline may also be applied to operating an electric tool deployed on coiled tubing. In other words, there is typically no power supplied to a tool assembly deployed on a coiled tubing.

POWER CONTROL INTERFACE

Figure 3:
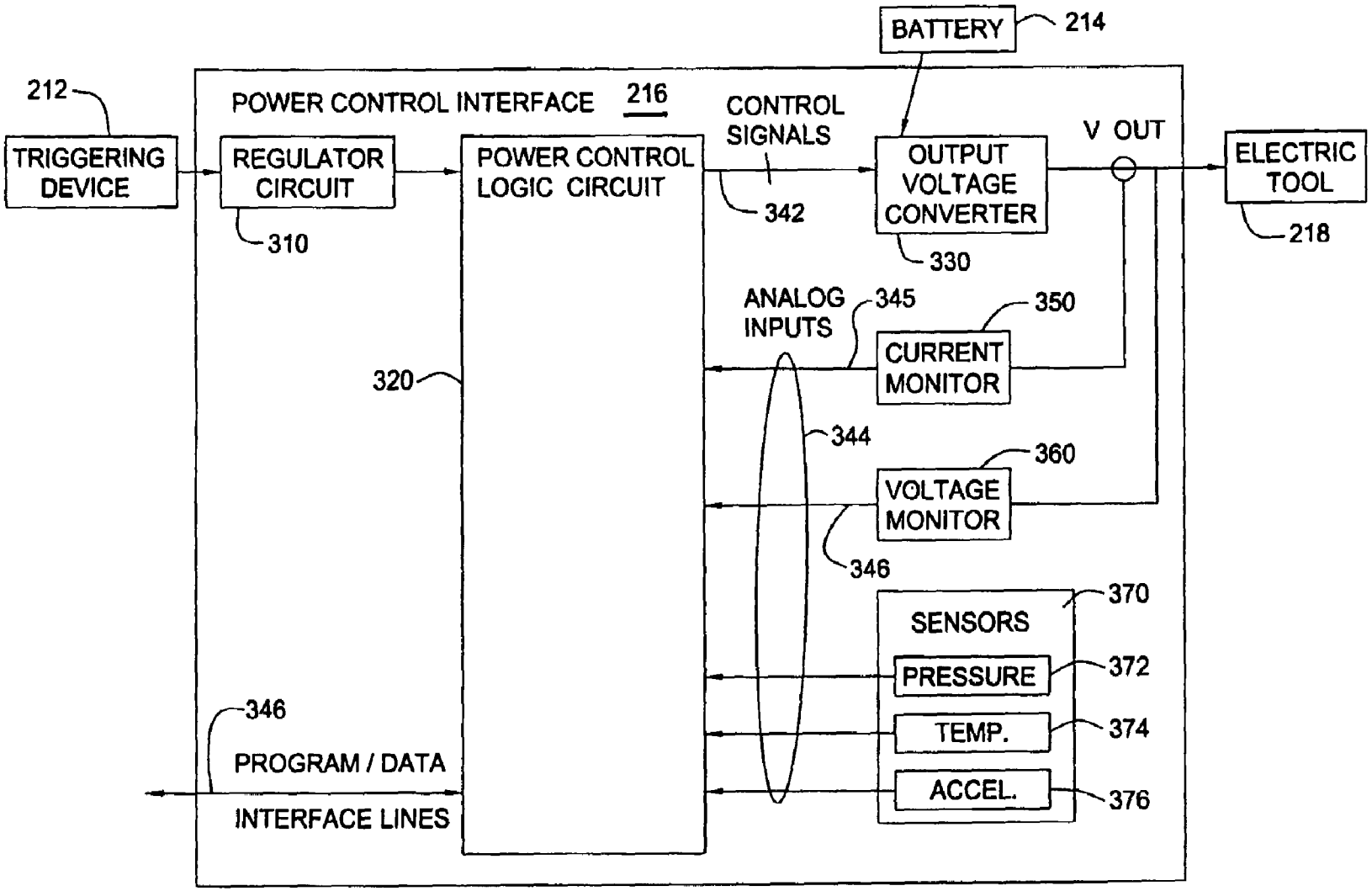
FIG. 3 illustrates a block diagram of a power control interface according to an embodiment of the present invention.

FIG. 3 illustrates a block diagram of an embodiment of the power control interface 216. As illustrated, the power control interface 216 comprises a regulator circuit 310, a power control logic circuit 320, an output voltage converter 330, a current monitor 350, a voltage monitor 360, and sensors 370.

The regulator circuit 310 regulates the trigger signal (which may be the battery voltage signal) to a suitable voltage level to operate the power control logic circuit 320. The output voltage converter 330 converts the battery voltage signal to an output voltage signal $V_{OUT}$ as a function of control signals 342 generated by the power control logic circuit 320. The control signals 342 determine a level of $V_{OUT}$ and whether $V_{OUT}$ is applied to the tool. Exemplary output voltages include, but are not limited to 24V, 120V, and 180V, and may be AC or DC. The output voltage converter 330 may comprise any suitable circuitry such as digital to analog converters (DACs), mechanical relays, solid state relays, and/or field effect transistors (FETs). Further, the output voltage converter 330 may generate different output voltages $V_{OUT}$ to power and control different tools autonomously.

The current monitor 350 and voltage monitor 360 monitor a current draw of the tool and a voltage applied to the tool, respectively, and provide analog inputs 344 to the power control logic circuit 320. Sensors 370 may comprise any combination of suitable sensors, such as a pressure sensor 372, a temperature sensor 374 and an accelerometer 376. For some embodiments, the power control logic circuit 320 may determine a triggering event has occurred based on analog inputs 344 provided by the sensors 370, eliminating a need for the external triggering device 212.

For some embodiments, the power control logic 320 may determine if one or more parameters in the wellbore are within a predetermined range prior to operating the tool 218. For example, the tool 218 may be an inflation tool and the power control logic 320 may confirm that downhole temperature is compatible with materials of an inflatable element prior to operating the tool to set the inflatable element. Further, for some embodiments, the power control logic 320 may also include circuitry for wireless communication of data from the sensors 370 to a surface. Monitoring downhole parameters prior to operating a tool and communicating sensor data to a surface is described in an application, filed herewith on Aug. 5, 2002, entitled "Inflation Tool with Real-Time Temperature and Pressure Probes" (U.S. Pat. No. 6,886,631), hereby incorporated by reference.

Figure 4:
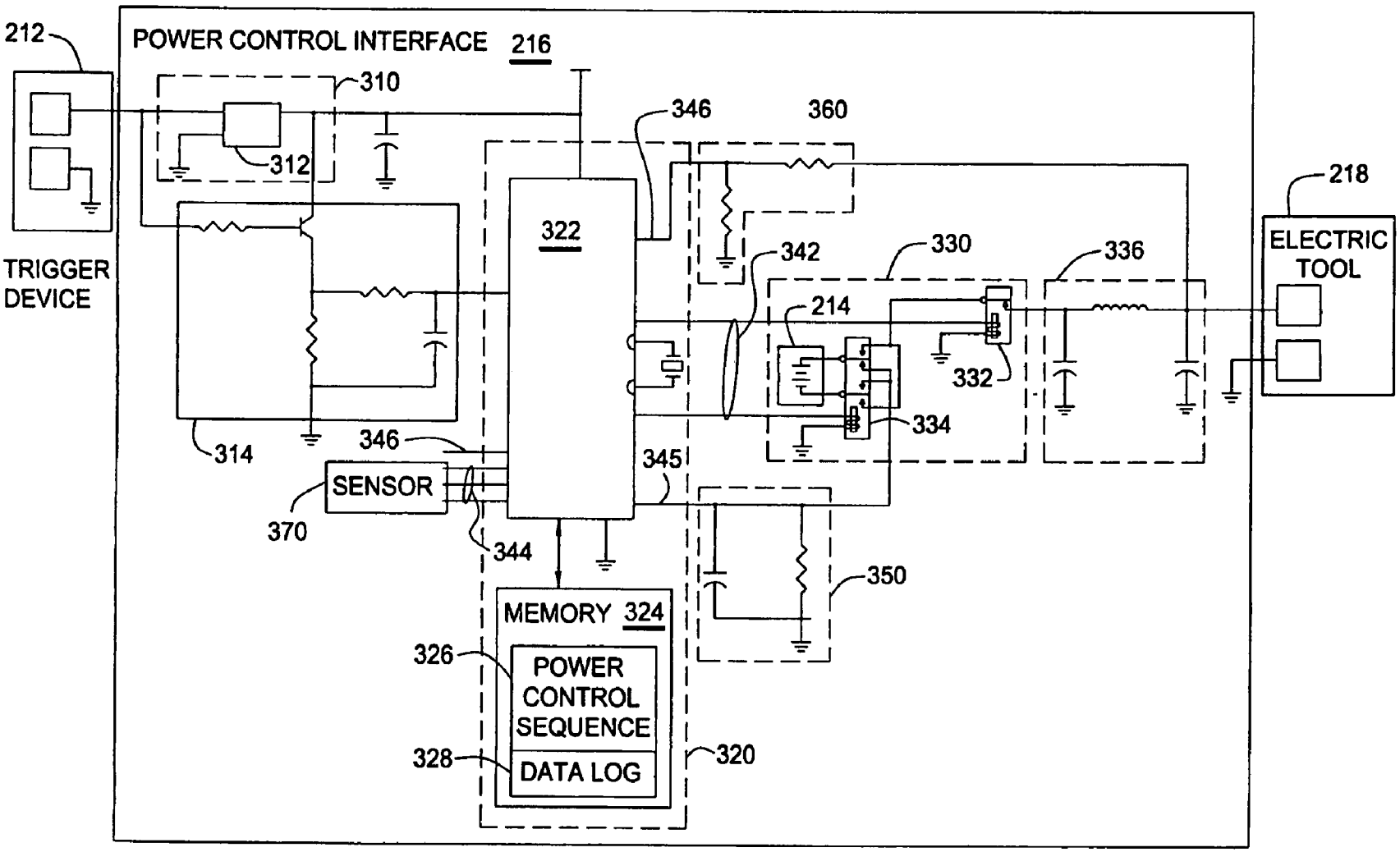
FIG. 4 illustrates a schematic view of a power control interface according to an embodiment of the present invention.

The power control logic circuit 320 may be any suitable circuitry to autonomously control the tool by varying the output voltage $V_{OUT}$ applied to the tool 218 according to a predetermined power control sequence. For example, as illustrated in FIG. 4, the power control logic circuit 320 may comprise a microprocessor 322 in communication with a memory 324. FIG. 4 is an exemplary schematic view of the power control interface 216.

Figure 5:
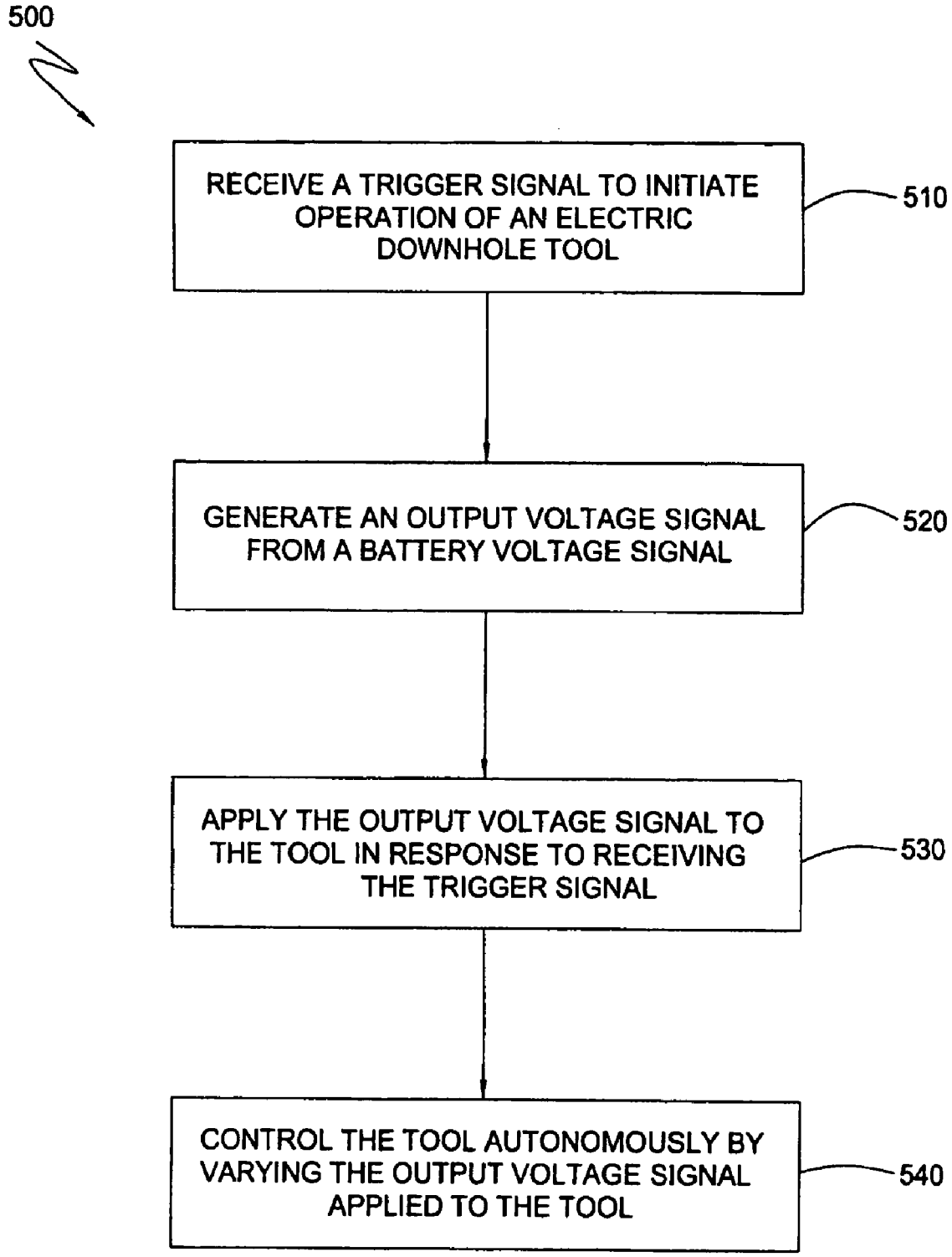
FIG. 5 is a flow diagram illustrating exemplary operations of a method according to an embodiment of the present invention.

FIG. 5 is a flow diagram illustrating exemplary operations of a method 500 according to an embodiment of the present invention. FIG. 5 may be described with reference to the exemplary embodiment of FIG. 4. However, it will be appreciated that the exemplary operations of FIG. 5 may be performed by embodiments other than that illustrated in FIG. 4. Similarly, the exemplary embodiment of FIG. 4 is capable of performing operations other than those illustrated in FIG. 5. It should also be noted that the listed components may be extended temperature components, suitable for downhole use (downhole temperatures may reach or exceed 300° F.).

The method 500 begins at step 510, by receiving a trigger signal from a triggering device. The trigger signal is regulated by the regulator circuit 310 to a supply voltage $V_{CC}$ suitable to power the power control logic circuit 320. The regulator circuit 310 may comprise a single regulator chip 312, or any other suitable circuitry. A reset circuit 314 holds the power control logic circuit 320 in a reset condition for a short period of time to ensure the trigger signal is valid and that the supply voltage $V_{CC}$ is stable.

For some embodiments, the power control logic circuit 320 may be powered from the trigger signal. Alternatively, the power control logic circuit 320 may be powered from an internal battery (not shown) or the external battery 214. A current draw of the power control logic circuit 320 may be insignificant when compared to a current draw of an attached tool 218. For some embodiments, the triggering device 212 supplies a battery voltage signal from the battery 214 as a trigger signal.

The power control logic circuit 320 comprises a microprocessor 322 and a memory 324. The microprocessor 322 may be any suitable type microprocessor configured to perform the power control sequence 326. The microprocessor may also be an extended temperature microprocessor suitable for downhole operations. Examples of extended temperature microprocessors include the 30100600 and 30100700 model microprocessors, available from Elcon Technology of Phoenix, Ariz., which are rated for operation up to 175° C. (347° F.).

The memory 324 may be internal or external to the microprocessor and may be any suitable type memory. For example, the memory 324 may be a battery-backed volatile memory or a non-volatile memory, such as a one-time programmable memory (OT-PROM) or a flash memory. Further, the memory may be any combination of suitable external or internal memories.

The memory 324 may store a power control sequence 326 and a data log 328. The data log 328 may store data read from the current monitor 350, voltage monitor 360, and sensors 370. For example, subsequent to operating the tool, the power control interface 216 may be retrieved from the well bore and the data log 328 may be uploaded from the memory 324 via the program/data interface lines 346 using any suitable communications protocol, such as a serial communications protocol. The data log 328 may provide an operator with valuable information regarding operating conditions.

The power control sequence 326 may be stored in any data format suitable for execution by the microprocessor 322. For example, the power control sequence 326 may be stored as executable program instructions. Alternatively, the power control sequence may be stored as parameters in a data file that specify voltage levels and cycle times or other parameters, such as temperature and/or pressure thresholds. The power control interface 216 may be configured to perform different power control sequences, thus allowing autonomously control of different tools. For example, different power control sequences may define output voltages of differing levels so a power control interface 216 may control tools with different operating voltages.

For some embodiments, the power control sequence 326 may be generated on a computer using any suitable programming tool or editor. For example, the power control sequence may be generated by compiling a ladder logic program created using a ladder logic editor. The ladder logic program may define various voltage levels, switching times and switching events, for example, based on inputs from the current monitor 350, voltage monitor 360, and sensors 370.

Alternatively, a power control sequence may be selected from a number of predefined power control sequences, for example, correspond to operating sequences for different tools. Accordingly, for some embodiments, a power control sequence may be chosen by selecting the corresponding tool. The power control sequence 326 may be downloaded to the memory 324 via the program/data interface lines 346 using any suitable communications protocol, such as a serial communications protocol.

Further, a set of predefined power control sequences may be stored in the memory 324. For some embodiments, the power control interface 216 may be configured by selecting one of the predefined power control sequences, for example, by downloading a selection parameter or by setting a selection switch on a PCB of the power control interface 216. The microprocessor 322 may read the downloaded selection parameter or the selection switch to determine which predetermined power control sequence to execute.

For step 520, an output voltage signal is generated from a battery voltage signal. For step 530, the output voltage signal is applied to the tool in response to receiving a trigger signal. The output voltage signal $V_{OUT}$ may be substantially equal to the battery voltage signal, or the output voltage converter 330 may transform (i.e. step up or step down) the battery voltage signal to generate a different output voltage signal. A voltage level of $V_{OUT}$ is determined by the tool 218, and a particular time in the power control sequence 326. For some embodiments, $V_{OUT}$ may be generated from the battery voltage signal prior to receiving the trigger signal. However, $V_{OUT}$ is not applied to the tool 218 prior to receiving the trigger signal.

For step 540, the output voltage signal applied to the tool is varied to autonomously control the tool. The output voltage signal $V_{OUT}$ is varied according to the power control sequence 326 performed by the microprocessor. The output voltage converter 330 may comprise any suitable circuitry to vary $V_{OUT}$ in response to control signals 342 generated by the microprocessor 322, as required by the power control sequence.

For example, the output voltage converter 330 may comprise a combination of relays 332 and 334 to apply $V_{OUT}$ to the tool 218. The relay 332 serves as a switch to apply $V_{OUT}$ to, or remove $V_{OUT}$ from, the tool 218. The relay 334 comprises a double pole relay suitable for reversing a polarity of $V_{OUT}$, by reversing a polarity of traces connected to different sets of inputs. In a first state, the relay 334 applies a positive $V_{OUT}$ to the tool 218, and in a second state the relay 334 applies a negative $V_{OUT}$ to the tool 218.

For other embodiments, the output voltage converter 330 may comprise other circuitry, such as digital to analog converters (DACs) to generate voltage steps of various levels in response to the control signals 342. As illustrated, an output filter circuit 336 may be disposed between the output voltage converter 330 and the tool 218. The output filter circuit 336 may comprise any suitable circuitry to filter $V_{OUT}$ applied to the tool 218, and may also function as a surge arrestor to prevent a large in-rush of current from the tool upon initial application and/or disconnections of $V_{OUT}$ to the tool 218. Further, the microprocessor 322 may be configured to perform a soft start of the tool 218 by slowly raising $V_{OUT}$ to a final value (for example, by pulsing the filter circuit 336) in an effort to minimize a stress and extend a life of the tool 218.

For some embodiments, the microprocessor 322 may vary $V_{OUT}$ as a function of one or more parameters monitored by sensors 370. For example, the microprocessor may discontinue operation if an operating temperature of the tool is exceeded. As another example, the microprocessor 322 may monitor a current draw of the tool as indicated by an analog input 345 generated by the current monitor 350. The microprocessor 322 may disconnect $V_{OUT}$ in response to determining the current draw to the tool has reached a predefined threshold limit, which may indicate a known event, such as a problem with the tool 218 or completion of a tool operation.

Further, for some embodiments, the microprocessor 322 may execute a power control sequence to autonomously control a plurality of tools. For example, the output voltage converter may include circuitry to generate more than one voltage, suitable for simultaneously operating more than one tool. The microprocessor 322 may operate a different power control sequence for tool, varying an output voltage supplied to each tool.

AUTONOMOUS INFLATABLE TOOL OPERATION

Figure 6:
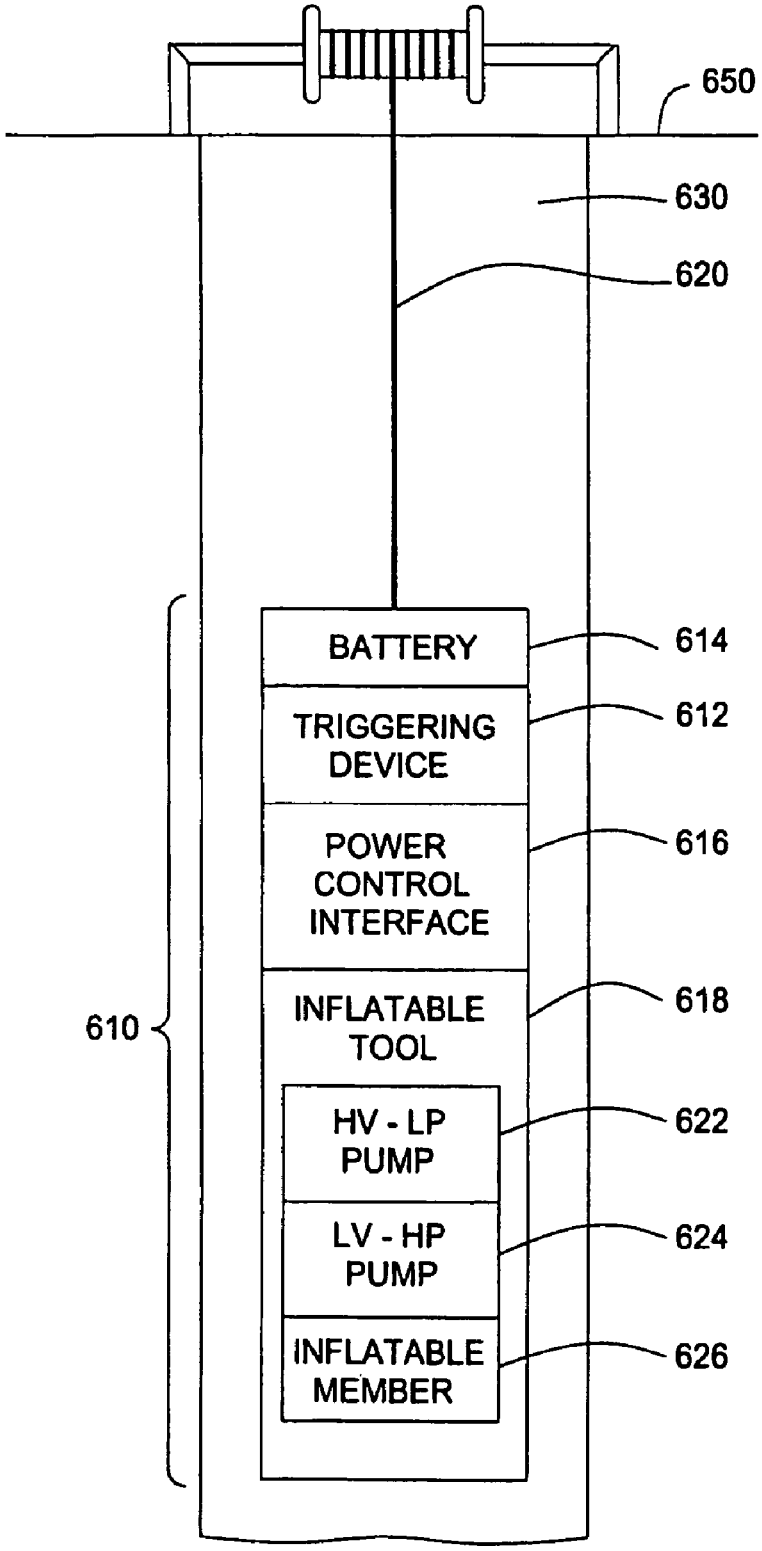
FIG. 6 illustrates an exemplary tool string comprising an inflatable tool according to an embodiment of the present invention.

An example of a tool that may be autonomously operated by monitoring current draw to the tool is an inflatable tool. FIG. 6 illustrates an exemplary tool string 610 attached to a non-electric (slickline or coiled tubing) 620, which is lowered down a well bore 630. The tool string 610 comprising a triggering device 612, a battery 614, a power control interface 616 and an inflatable tool 618. As illustrated, the inflatable tool 618 may comprise a high volume-low pressure pump 622 and a low volume-high pressure pump 624 for inflating an inflatable member 626. Similar to the tool described in FIG. 2, power control operations are traditionally performed via wireline by an operator on a surface 650 are performed by the power control interface 616.

Figure 7:
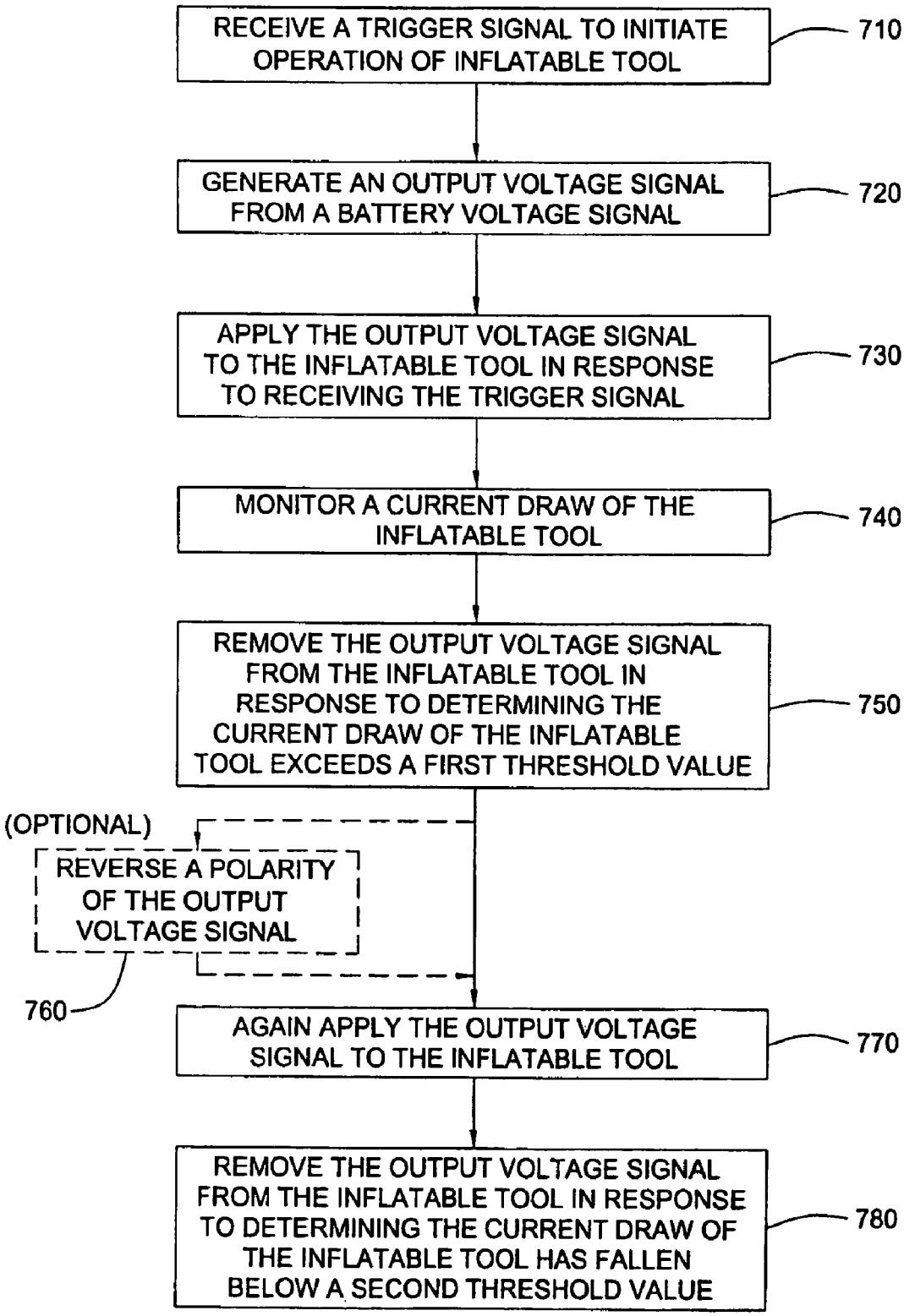
FIG. 7 is a flow diagram illustrating exemplary operations of a method for operating an inflatable tool according to an embodiment of the present invention.

FIG. 7 is a flow diagram illustrating exemplary operations of a method 700 for operating an inflatable tool according to an embodiment of the present invention. The exemplary operations of FIG. 7 may be illustrated with reference to FIG. 6 and FIG. 8, which illustrates an exemplary graph of current and voltage supplied to an inflatable tool as a function of time. The voltages, currents and time are for illustrative purposes only, and may vary according to a particular inflatable tool.

Steps 710 through 730 mirror the operations of steps 510 through 530 of FIG. 5. The method 700 begins at step 710, by receiving a trigger signal from a triggering device. For step 720, an output voltage signal is generated from a battery voltage signal. For step 730, the output voltage signal is applied to the inflatable tool in response to receiving the trigger signal. In response to the applied voltage signal, the inflatable tool may begin inflating the inflatable member 626 with the high volume-low pressure pump 622.

Figure 8:
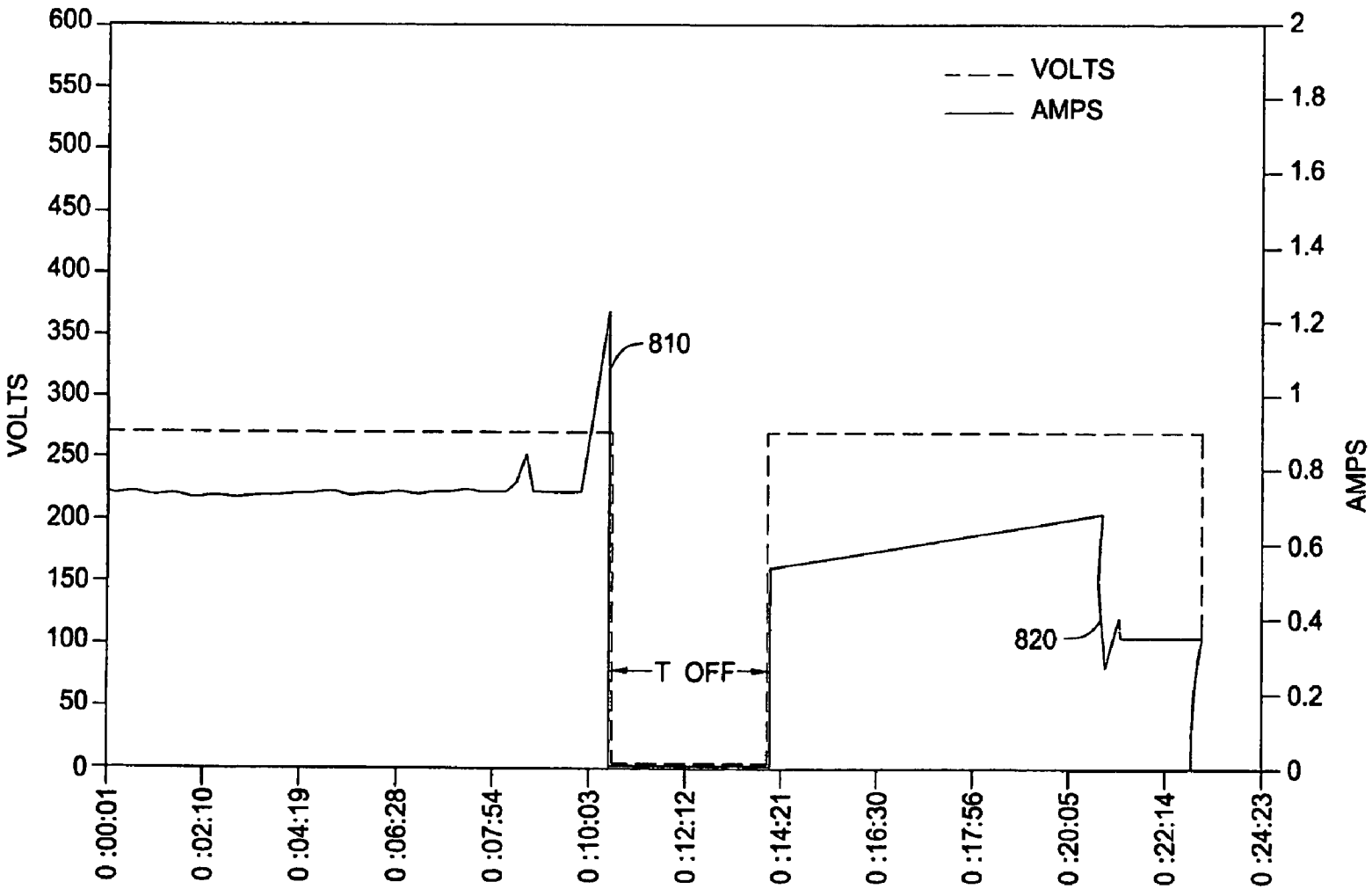
FIG. 8 is an exemplary voltage-current diagram of an inflatable tool.

For step 740, a current draw of the inflatable tool is monitored. For step 750, the output voltage supplied to the inflatable tool is removed in response to determining the current draw of the inflatable tool is greater than a first threshold value. For example, the current draw of the inflatable tool 618 may be proportional to a pressure of an inflatable member 626. Referring to FIG. 8, a sharp rise 810 in the current draw of the inflatable tool, may indicate the high volume-low pressure pump 622 has inflated the inflatable member 626 to a predetermined pressure. The output voltage signal disconnected from the inflatable tool corresponds to the zero voltage in FIG. 8 for the cycle time $T_{OFF}$.

For step 770, the output voltage signal is again applied to the inflatable tool 618. In response to the output voltage signal applied again, the inflatable tool may begin inflating the inflatable member 626, this time with the low volume-high pressure pump 624, which may be able to inflate the inflatable member 626 to a higher pressure than the high volume-low pressure pump 622. For some inflatable tools, a second pump (or pumping operation) may be operated by applying a voltage signal of opposite polarity to the inflatable tool. Therefore, for optional step 760, a polarity of the output voltage signal is reversed prior to again applying the output voltage signal to the inflatable tool.

For step 780, the output voltage signal is removed from the inflatable tool 618 in response to determining the current draw of the inflatable tool has fallen below a second threshold value. For example, the inflatable tool 618 may be designed to automatically release from the inflatable member 626 when the inflatable member 626 is inflated to a predetermined pressure. This automatic release may be indicated by a sharp decrease 820 in the current draw of the inflatable tool 618.

AUTONOMOUS PERFORATING TOOL OPERATION

Figure 9A:
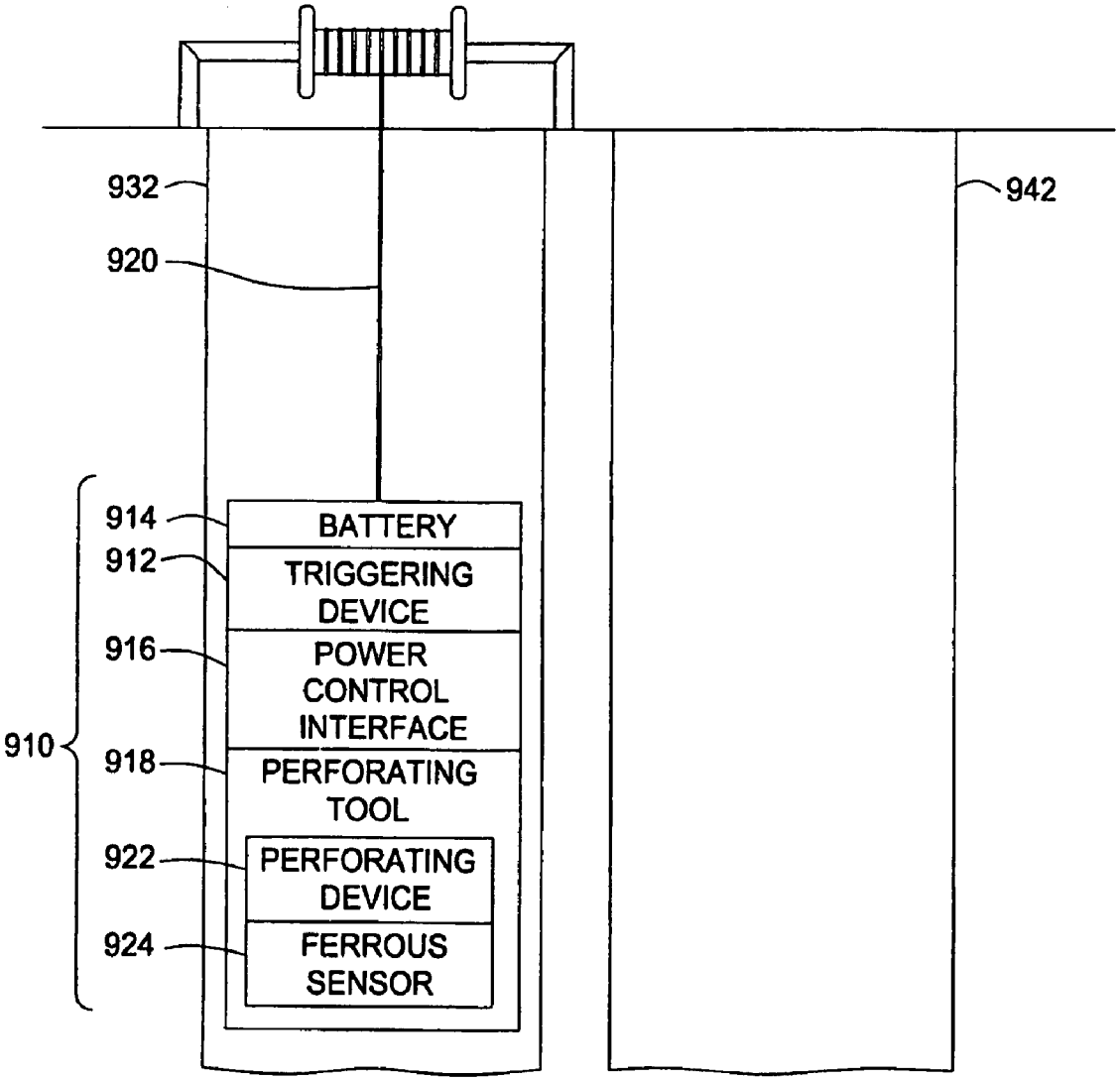
FIGS. 9A and 9B illustrate a side view and a top view, respectively, of an exemplary tool string for perforating a pipe according to an embodiment of the present invention.
Figure 9B:
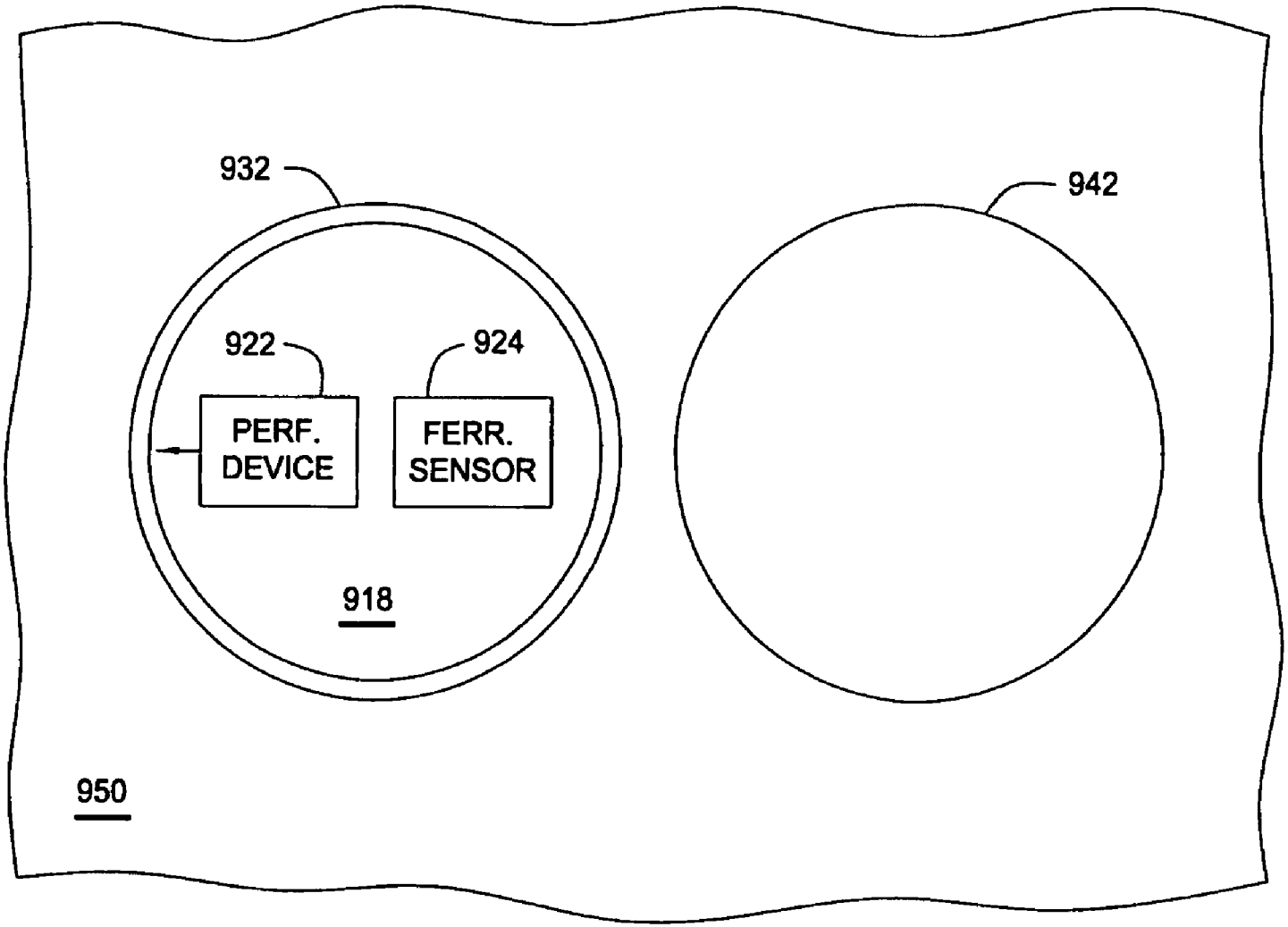

Another example of a tool that may be autonomously operated by a power control interface is a perforating tool. FIGS. 9A and 9B illustrate a side view and a top view, respectively, of an exemplary tool string 910 attached to a slickline 920. The tool string 910 comprises a trigger device 912, a battery 914, a power control interface 916 and a perforating tool 918 for perforating a pipe 932. The perforating tool 918 may be anchored to a fixed location in the pipe 932 prior to the operations described below. For example, the perforating tool 918 may be anchored by an inflatable packing device (not shown), according to the previously described method. One challenge in operating the perforating tool 918 is to perforate the pipe 932 without causing damage to an adjacent pipe 942.

Accordingly, the perforating tool 918 may comprise a ferrous sensor 924 to detect a location of the adjacent pipe 942. As illustrated in FIG. 9B, the ferrous sensor 924 may be located to generate a signal when a perforating device 922 is pointing in an opposite direction of the adjacent pipe 942. The tool 924 is commonly referred to as an electromagnetic orienting (EMO) tool. The power control interface may generate a signal to rotate the perforating tool 918 while monitoring the signal generated by the ferrous signal to determine a direction of the perforating device 922 with respect to the adjacent pipe 942. The power control interface 916 may then generate a signal to fire the perforating device 922 in response to determining the perforating device 922 is pointing away from the adjacent pipe 942.

Figure 10:
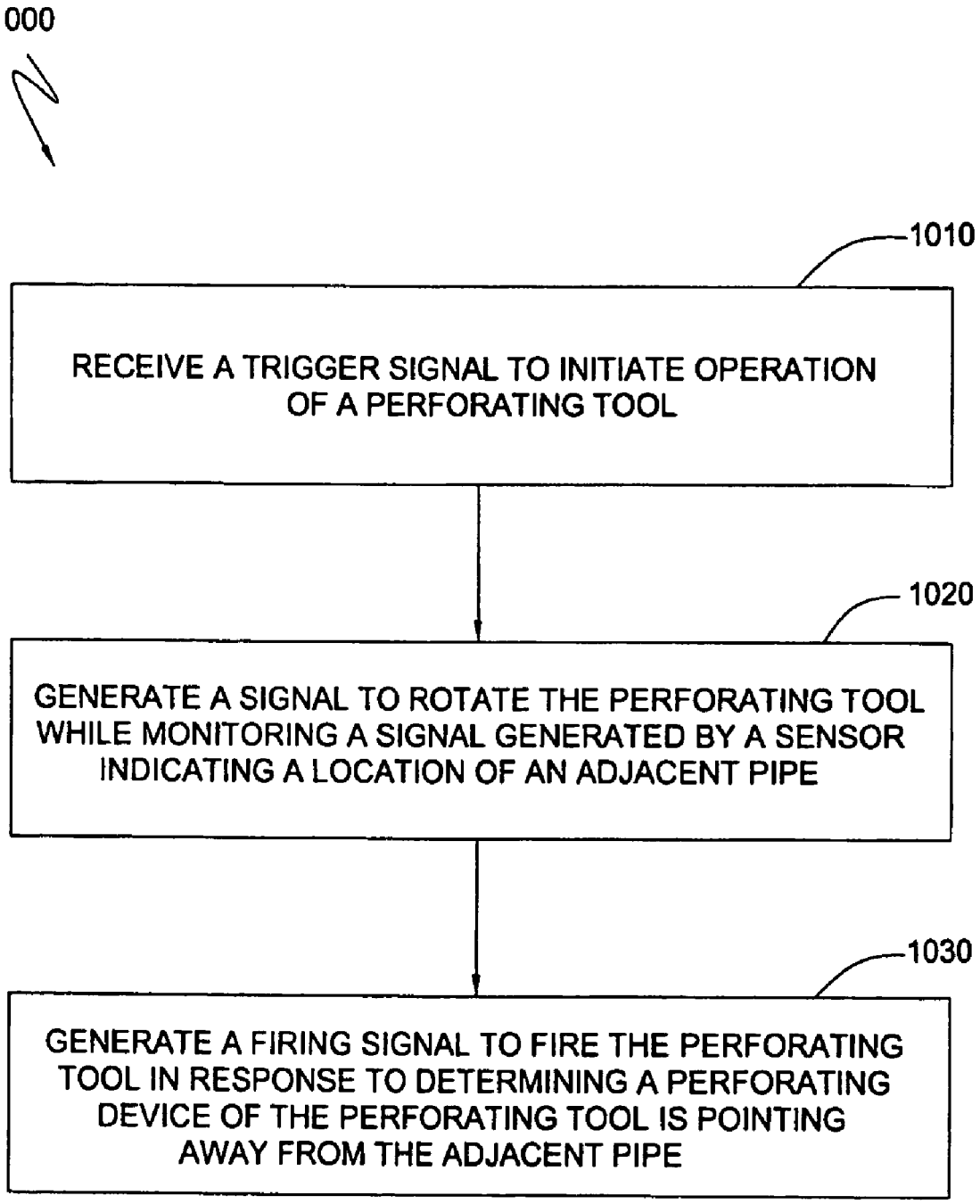
FIG. 10 is a flow diagram illustrating exemplary operations of a method for operating a perforating tool according to an embodiment of the present invention.

FIG. 10 is a flow diagram illustrating exemplary operations of a method 1000 for operating a perforating tool according to an embodiment of the present invention. At step 1010, the power control interface 916 receives a trigger signal from the triggering device 912. At step 1020, the power control interface 916 generates a signal to rotate the perforating tool 918 while monitoring the signal generated by the ferrous sensor 924. At step 1030, the power control interface 916 may then generate a firing signal to fire the perforating device 922 in response to determining the perforating device 922 is pointing away from the adjacent pipe 942.

Because of the possible damage that may be caused to the adjacent pipe, additional steps may be taken for redundancy. For example, the power control interface 916 may rotate the perforating device 922 at least one additional rotation while monitoring the signal generated by the ferrous sensor 924. The power control interface 916 may compare a location indicated by the signal generated on the additional rotation to a location indicated by the prior signal to ensure both signals indicate a consistent location. If both signals indicate a consistent location, the power control interface 916 may generate the firing signal to fire the perforating device 922. However, if the signals indicate inconsistent results, additional rotations may be monitored or the operations may be terminated to avoid possibly damaging the adjacent pipe 942.

For some embodiments, the ferrous sensor 924 and perforating device 922 may rotate independently of each other. Accordingly, the method described above may be modified such that the power control interface 916 may rotate the ferrous sensor 924 to determine a location of the adjacent pipe 942 and subsequently rotate the perforating device 922. Further, the method described above may also be modified to fire a perforating device away from more than one adjacent pipe.

Embodiments of the present invention provide a method, system and apparatus for autonomous control of downhole tools on inexpensive slickline, which may reduce operating costs. A power control interface performs power control operations traditionally performed via wireline by an operator on the surface. Accordingly, operating costs may be further reduced by limiting a number of skilled operators required to operate the tool.

While the foregoing is directed to embodiments of the present invention, other and further embodiments of the invention may be devised without departing from the basic scope thereof, and the scope thereof is determined by the claims that follow.

The invention claimed is:

1. A system comprising:

a non-electric cable;

an electromagnetic orienting (EMO) perforating tool attached to the non-electric cable; and a power control interface comprising an output voltage circuit to generate an output voltage signal and a microprocessor configured to autonomously control the perforating tool by applying the output voltage signal to the tool and varying the output voltage signal according to a power control sequence stored in a memory.

2. The system of claim 1, wherein the output voltage is derived from a battery disposed in the perforating tool.

3. The system of claim 1, wherein the power control sequence comprises rotating the perforating tool while monitoring a sensor for a signal indicative of a location of an adjacent wellbore member.

4. The system of claim 1, wherein the power control sequence further comprises firing the perforating tool in response to determining the perforating tool is at a predetermined location relative to an adjacent wellbore member.

5. A method for operating an electromagnetic orienting (EMO) perforating tool in a wellbore, The method comprising:

lowering the perforating tool into the wellbore on a non-conductive member;

generating an output voltage signal;

receiving a trigger signal by a microprocessor in a power control interface attached to the perforating tool, wherein the trigger signal is generated by a triggering device; and controlling the perforating tool by varying the output voltage signal to the perforating tool according to a power control sequence executed by the microprocessor.

6. The method of claim 5, further including rotating the perforating tool while monitoring a signer generated by a sensor indicating a location of an adjacent wellbore member.

7. The method of claim 6, further including comparing the signal generated by the sensor to a signal previously generated to ensure the location of the adjacent wellbore member.

8. The method of claim 6, further including firing the perforating tool in response to determining the perforating tool is at a predetermined location relative to the adjacent wellbore member.

9. The method of claim 5, wherein the output voltage is derived from a battery disposed in the perforating tool.

10. The method of claim 5, further including generating the trigger signal in response to a sensor sensing a wellbore parameter.

11. A system comprising:

an electric downhole tool;

a power control interface coupled to the electric downhole tool, wherein the power control interface is configured to vary an output voltage to the electric downhole tool in response to a sensed wellbore parameter;

a triggering device coupled to the power control interface and configured for supplying a trigger signal thereto; and a battery coupled to the triggering device for supplying a voltage thereto.

12. A method for operating an electromagnetic orienting (EMO) perforating tool in a first pipe adjacent to a second pipe, the method comprising:

lowering the perforating tool into a wellbore on a substantially non-electrically conducting cable;

receiving a trigger signal to initiate operation of the perforating tool;

operating the perforating tool by utilizing a power control interface attached to the tool by varying an output voltage supplied to the tool in accordance with a power control sequence;

rotating the perforating tool while monitoring a sensor for a signal indicative of a location of the second pipe; and firing the perforating tool in response to detecting the signal indicative of a location of the second pipe.

13. The method of claim 12, wherein a voltage supplied to the power control interface is generated by a battery disposed in the perforating tool.

* * * * *

UNITED STATES PATENT AND TRADEMARK OFFICE

CERTIFICATE OF CORRECTION

PATENT NO. : 7,152,680 B2
APPLICATION NO. : 11/209899
DATED : December 26, 2006
INVENTOR(S) : Wilson et al.

It is certified that error appears in the above-identified patent and that said Letters Patent is hereby corrected as shown below:

In the Claims:

Column 10, Claim 5, Line 2, please delete "The" and insert --the--;
Column 10, Claim 6, Line 16, please delete "signer" and insert --signal--.

Signed and Sealed this

Seventh Day of August, 2007

JON W. DUDAS
*Director of the United States Patent and Trademark Office*